US005096115A

United States Patent [19]

Hassan

[11] Patent Number: 5,096,115

[45] Date of Patent: Mar. 17, 1992

[54] MAIL THEFT-PREVENTIVE MAILBOX

[76] Inventor: Shawky A. Hassan, 1146 S. Linden Rd., Flint, Mich. 48504

[21] Appl. No.: 371,616

[22] Filed: Jun. 26, 1989

[51] Int. Cl.[5] ..... B65D 91/00

[52] U.S. Cl. ..... 232/17; 232/43.1; 232/45

[58] Field of Search ..... 232/43.1, 17, 45

[56] References Cited

U.S. PATENT DOCUMENTS

| | | | |
|---|---|---|---|
| 1,992,640 | 2/1935 | Steen . | |
| 2,477,276 | 7/1949 | Walton | 232/39 |
| 2,602,584 | 7/1952 | Croft | 232/43.1 |
| 2,781,964 | 2/1957 | Ledgerwood . | |
| 3,735,919 | 5/1973 | Morgan . | |
| 3,874,583 | 4/1975 | Moll | 232/17 |
| 3,880,344 | 4/1975 | Earle . | |
| 4,186,869 | 2/1980 | Brown . | |
| 4,345,710 | 8/1982 | Gillespie et al. . | |
| 4,793,551 | 12/1988 | Baylor | 232/45 X |
| 4,844,332 | 7/1989 | Long | 232/17 |
| 4,905,891 | 3/1990 | Wildish et al. | 232/17 |

*Primary Examiner*—Robert W. Gibson, Jr.
*Attorney, Agent, or Firm*—Gifford, Groh, Sprinkle, Patmore and Anderson

[57] ABSTRACT

A mailbox having a mail receiving end, a mail storage end, and an inclined intermediate body portion therebetween. The mail receiving end has an outgoing mail holding shelf provided therein and a pivotably attached door attached thereto. The mail storage end holds the received mail therein and includes a lockable mail access door for removal of the mail therefrom. The back side of the mail storage end is flat and includes an upper extending flange, such construction allowing for placement of the mailbox on a conventional mailbox post. The inclined body portion is long enough and angled to thereby prevent removal of mail by reaching into the mail receiving end.

20 Claims, 2 Drawing Sheets

MAIL THEFT-PREVENTIVE MAILBOX

BACKGROUND OF THE INVENTION

I. Field of the Invention

The present invention relates to mailboxes, and more particularly relates to mailboxes designed to prevent the theft of mail therefrom.

II. Description of the Prior Art

Mailboxes have long been provided in simple constructions. The conventional mailbox in the United States comprises a horizontally elongated mailbox portion having a door placed pivotably at the front or open end of the box. The door includes a latch or a handle for grasping of the door for opening and closing. Known boxes conventionally are fittable onto mounting posts or mailbox supports. While such mailboxes are practical for many mail recipients, these boxes do pose certain disadvantages.

Among the disadvantages commonly associated with conventional mailboxes is the important disadvantage that conventional mailboxes offer virtually no method of preventing theft of mail therefrom. The door on the front of the mailbox is openable and closeable without a lock, to thereby permit the mail person to insert mail therein. Naturally, it is unreasonable to suggest putting locks on conventional mailboxes in that such locks would require the mail person to carry a different key for every box on his or her mail route.

It is conceivable that a conventional mailbox could be locked by the mailbox owner and a slot could be cut into the door of the box to allow insertion of mail therethrough. However, this solution is ultimately undesirable in that only flat mail could be inserted, and even then only mail of a specific envelope size. Accordingly, the insertion of other articles which are commonly transported through the mail such as small boxes or large envelopes would be frustrated by this approach to preventing mail thief.

Certain elaborate schemes have been devised for the prevention of theft of mail from a mailbox. The most common such box is the conventional U.S. post box into which is placed the mail of the mailer for storage until the post office has the opportunity to pick up the mail at a fixed pick-up time. This construction allows for the user to open the mail door, place the mail therein, and close the door having the mail fall deep inside of the mailbox. However, such boxes are far too bulky for use by the general consumer.

Other elaborate schemes are known for securely keeping delivered mail. For example, in U.S. Pat. No. 3,880,344, issued to Earle and entitled "Secured Mailbox", a mailbox is closed in a way which is more or less similar to the U.S. post box in that a handle is pulled, the mail is placed upon the inner portion of the handle, the handle is released and the mall falls inside the mailbox. However, such mailboxes are overly cumbersome and are not fittable onto conventional mailbox posts. This latter requirement is important because a mailbox post is conventionally placed into the ground and is anchored in place by cement which forms a more or less permanent anchor. If one were to replace a conventional mailbox with a security mailbox according to the invention of Earle, an entirely different mailbox post will be required, thus virtually making such mailbox use impractical.

Accordingly, the problem of providing a theft-preventive mailbox which provides both security and convenience of installation for the user remains unsolved as prior inventions have failed to eliminate the problems commonly associated with known mailboxes.

SUMMARY OF THE PRESENT INVENTION

The present invention provides a mailbox having a mail receiving end, a mail storage end, and an inclined intermediate body portion included therebetween. The mail receiving end has an outgoing mail holding shelf provided therein and a door pivotably attached thereto. The mail storage end holds the received mail therein and includes a lockable mail access door for removal of the mail therefrom. The backside of the mail storage end is flat and includes an upper extending flange, such construction allowing for placement of the mailbox on a conventional mailbox post. The inclined body portion is long enough and includes bends to prevent removal of mail by the human arm attempting to reach into the mail receiving end.

The mailbox body is preferably constructed of a lightweight metal such as aluminum, or, alternatively, may be composed of a rigid polymerized material such as the type of vinyl used to manufacture modern ski boots. This sort of vinyl is known to withstand extremes in temperatures of between −70° F. and 200° F. In addition to having the thermal characteristics described above, this material also withstands bumping and battery.

Approximately above the sliding door provided at the front side of the mail storage end there is provided an outwardly extending lip overhanging the sliding access door. This lip offers the advantage of keeping rain or other moisture from entering into the storage area of the box. Similiarly, approximately above the mail receiving door at the upper end of the mailbox is also provided a shroud to keep out rain and other moisture.

The slidable access door is lockable by means of a conventional padlock. This construction provides the mailbox with added security.

Attachment of the mailbox to a mailbox post is similar to that conventionally provided in that the mailbox may be fitted to a conventional post. To accommodate this construction, the backside of the mail storage end of the mailbox is substantially flat and has at its approximate upper end an upper extending flange. This construction allows the mailbox to be placed up against and downwardly pressing upon a conventional mailbox post.

Because the mailbox according to the present invention includes an inclined intermediate body portion, the mail receiving end is substantially offset from the lower mail storage end. This construction provides for placement of the mailbox on a conventional post, however the conventional post itself may be set back further away from the edge of the roadway, thereby providing the mailbox with greater protection from damage which might be caused by automobiles driving off of the roadway.

The mailbox according to the present invention offers a significant advantage in that the home owner may leave for an extended weekend or holiday without fear that his mail service will be interrupted and further without fear that his mail will be improperly taken.

Other advantages and features of the present invention will become more apparent from the following detailed description when read in conjunction with the accompanying drawings.

BRIEF DESCRIPTION OF THE DRAWINGS

The present invention will be more fully understood by reference to the following detailed description of the preferred embodiment of the present invention when read in conjunction with the accompanying drawing, in which like reference characters refer to like parts throughout the views, and in which.

DETAILED DESCRIPTION OF THE PREFERRED EMBODIMENT OF THE PRESENT INVENTION

FIGS. 1-7 show a preferred embodiment of the present invention. While the configuration according to the illustrated embodiment is preferred, it is envisioned that alternate configurations of the present invention may be adopted without deviating from the invention as portrayed. The preferred embodiment is discussed hereafter.

Figures 1, 2, 3:
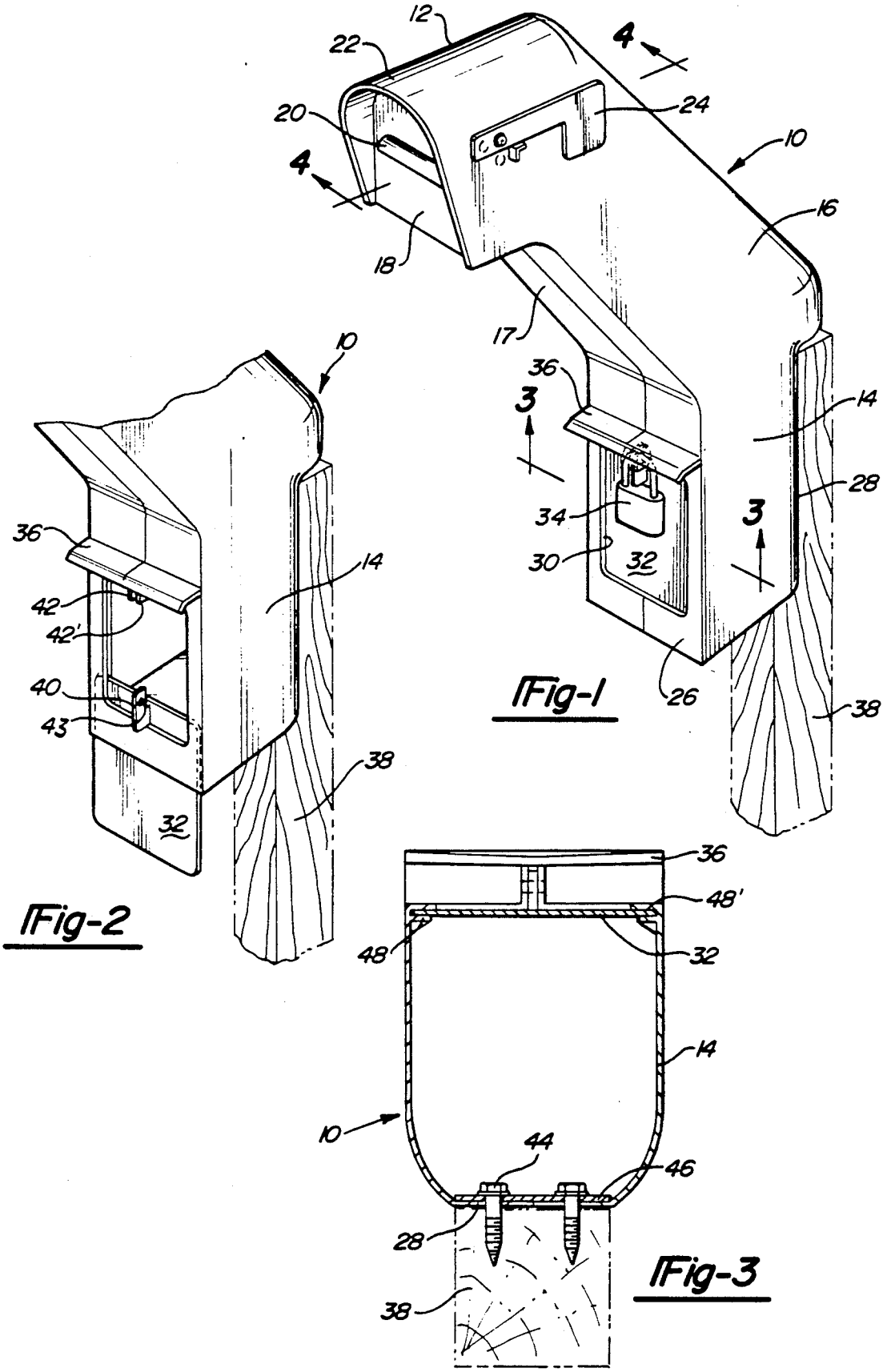
FIG. 1 is a perspective view of the mailbox according to the present invention and placed upon a mailbox post, only partially shown.
FIG. 2 is a partial perspective view of the view shown in FIG. 1 illustrating the mail storage access door in its opened position.
FIG. 3 is a sectional view taken along line 3—3 of FIG. 1.

Referring to FIG. 1, a perspective view of the mailbox according to the present invention is illustrated in place upon a mailbox post. The mailbox is generally indicated as 10. The mailbox 10 includes three indivisible portions, to wit, a mail receiving end 12, a mail storage portion 14, and an inclined intermediate portion 16. Basically, incoming mail is inserted into the mail receiving end 12, slides down the inclined intermediate portion 16, and comes to rest within the mail storage portion 14.

The mail receiving end 12 includes an inlet door 18 having provided thereon a handle 20. The door 18 is pivotally mounted to the mail receiving end 12 in a conventional manner. Above the inlet door 18 is provided an inlet door shroud 22 which extends over and beyond the inlet door 18. The shroud 22 is provided to eliminate or minimize entrance into the mailbox of rain or other moisture. The opening at the mail receiving end 12 is preferably between eight and nine inches high.

To the side of the mailbox 10 is pivotally mounted a flag 24. The flag 24 operates in a conventionally known manner, that is, when outgoing mail is waiting in the box, the flag 24 is placed in its "up" or extended position. Otherwise the flag 24 is placed in its "down" position.

The inclined intermediate portion 16 allows incoming mail to slide therethrough and therealong for storage in the mail storage portion 14. The inclined intermediate portion 16 includes a base 17 upon which the mail interiorly slides. The length of the base is preferably at least thirteen inches long. The inclusion of the inclined intermediate portion 16 in the design of the mailbox 10 offers two significant advantages. First, and foremost, unauthorized removal of stored mail is prevented in that a would-be thief's arm could not bend or reach sufficiently into the mailbox 10 according to the preferred measurements to grasp the stored mail. The forearm simply could not pass the first bend between the mail receiving end 12 and the inclined intermediate portion 16.

Second, the offset between the mail receiving end 12 and the mail storage portion 14 created by the inclined intermediate portion 16 allows for setback placement of the mailbox 10 away from the roadway. This setback minimizes risk of damage to the mailbox 10 by road traffic.

The mail storage portion 14 includes a front side 26 and a back side 28. The front side 26 has defined therein an access door aperture 30. A sliding access door 32 is slidingly provided substantially at the access door aperture 30. The access door 32 is locked closed by the locking attachment thereto of a conventional padlock 34.

Approximately above the access door aperture 30 is provided an outwardly-extending lip 36. The lip 36 prevents the entrance into the storage portion 14 of rain or other moisture, and in this way is substantially similar in purpose to the shroud 22 provided on the mail receiving end 12.

The back side 28 abuts a mailbox post 38. While the mailbox post 38 is illustrated here as being square and wooden, other posts may be used and may have round or other shapes and may be composed of a metal or a plastic.

The mailbox 10 and some or all of its component parts may be composed of a metal, such as aluminum, as is conventionally known. The mailbox 10 may alternately be composed of a polymerized material such as a plastic or vinyl. Preferably, a high-impact vinyl may be employed, such as that used in the manufacture of housings for modern ski boots. This material is known for its resiliency and resistance to great variations in temperature (from −70° F. to 200° F.).

FIG. 2 illustrates a partial view of FIG. 1 with the sliding access door 32 in its opened position, thus allowing for the removal of mail from the mail storage portion 14. Once the padlock 34 (shown in FIG. 1) is removed, the access door 32 slides down.

The door 32 is held into its closed position by an access door locking bar 40 having an access door locking bar aperture 43 defined therein being substantially aligned with apertures (not shown) defined in a pair of fixed locking bars 42, 42'. With the apertures aligned, the padlock 34 may be attached. With the padlock 34 removed, the access door 32 slides open into the position illustrated in FIG. 2.

FIG. 3 illustrates a sectional view taken along line 3—3 of FIG. 1. This view shows how the mailbox 10 is fixed to the post 38 by use of a pair of attachment screws 44. The screws 44 are set in place through a reinforcing plate 46.

While attachment of the mailbox 10 to the post 38 is illustrated using the screws 44, other methods of attachment are possible and should be noted. For example, if the mailbox 10 is fixed to a round post (not illustrated), a U-bolt would be employed. The back side 28 of the mail storage portion 14 is substantially flat to thereby rest flushly against a square post, if used.

FIG. 3 also illustrates the construction of the access door 32 made slidable by a pair of access door slide channels 48, 48'.

Figure 4:
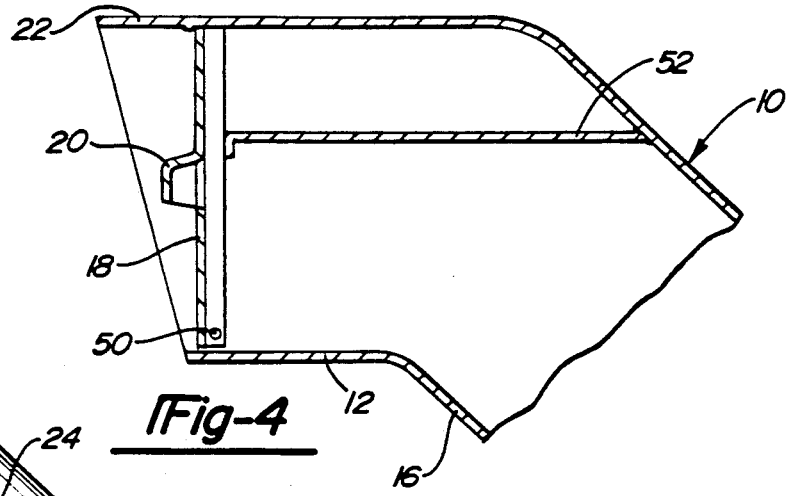
FIG. 4 is a sectional view taken along line 4—4 of FIG. 1.

With reference to FIG. 4, a sectional view of the mailbox 10 taken along line 4—4 of FIG. 1 is illustrated. This view more fully illustrates the relationship of the mail receiving end 12 to the inclined intermediate portion 16. This view also more clearly illustrates the placement of the door 18 with respect to the mail receiving end 12. The door 18 is made pivotably operable by a pivoting fastener 50.

The present invention includes an outgoing mail shelf 52 fitted within the mail receiving end 12. The shelf 52 is transversely provided and allows for convenient placement of outgoing mail.

Figure 5:
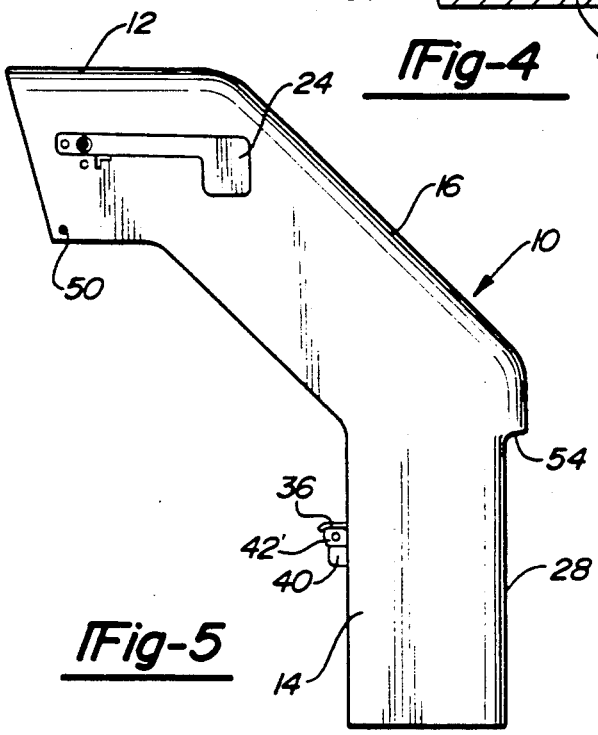
FIG. 5 is a side elevational view of the present invention to more fully illustrate its external construction.

FIG. 5 illustrates a raised elevational side view of the mailbox 10. This view perhaps most clearly reveals the offset of the mail receiving end 12 with respect to the mail storage portion 14 created by the inclined intermediate portion 16.

At approximately the uppermost portion of the back side 28 is provided a mailbox post abutment flange 54. This flange is provided to allow the weight of the mailbox 10 to substantially rest upon a mailbox post regardless of the shape of the post, so long as the post has a substantially flat top. Accordingly, round, square, or rectangular posts can support the mailbox 10 in combination with fasteners discussed above with respect to FIG. 3.

Figure 6:
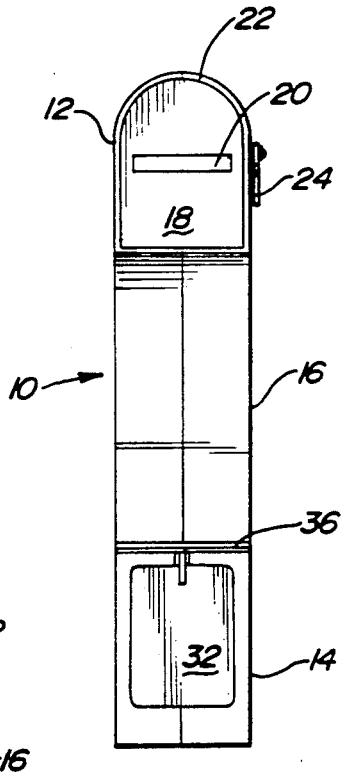
FIG. 6 is a front elevational view of the view of FIG. 5.

FIG. 6 illustrates a front elevational view of the mailbox 10 to clearly show its principal parts. Note that the access door 32 is in its closed position.

Figure 7:
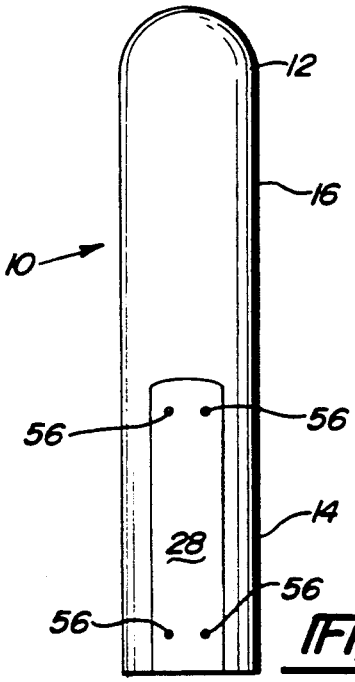
FIG. 7 is a rear elevational view of the view of FIG. 5.

FIG. 7 illustrates a rear elevational view of the mailbox 10 to also clearly show the principal parts and their relationships to one another. A number of fastening apertures 56 are visible.

Having described my invention, however, many modifications thereto will become apparent to those skilled in the art to which it pertains without deviation from the spirit of the invention as defined by the scope of the appended claims.

I claim:

1. A mailbox comprising:

a horizontal mail receiving portion;

an inclined intermediate mail passage portion interconnected with said horizontal mail receiving portion;

a vertical mail holding portion interconnected with said intermediate mail passage portion; and said vertical mail holding portion having a vertical mailbox post attachment region;

said horizontal mail receiving portion being offset relative said mailbox post attachment region;

whereby mail placed within said horizontal mail receiving portion slides along said inclined intermediate mail passage portion to fall into and be temporarily stored within said vertical mail holding portion.

2. A mailbox comprising:

a horizontal mail receiving portion;

an inclined intermediate portion having an upper end and a lower end, said upper end of said inclined portion being interconnected with said horizontal mail receiving portion;

a vertical mail holding portion interconnected with said lower end of said inclined intermediate portion; and said vertical mail holding portion having a vertical mailbox post attachment region;

said horizontal mail receiving portion being offset relative said mailbox post attachment region;

whereby mail placed within said horizontal mail receiving portion slides along said inclined intermediate portion to fall into and is temporarily stored within said vertical mail holding portion.

3. The mailbox according to claim 2 wherein said horizontal mail receiving portion includes a door end, said door end including an openable door for insertion of mail therein, said door end having height and width, said openable door having a vertical closed position.

4. The mailbox according to claim 3 wherein said openable door is pivotably mounted to said door end.

5. A mailbox comprising:

a mail receiving portion;

an inclined intermediate portion having an upper end and a lower end, said upper end of said inclined portion being interconnected with said mail receiving portion; and a mail holding portion interconnected with said lower end of said inclined portion;

said mail receiving portion having provided therein a shelf for placement thereon of outgoing mail;

whereby mail placed within said mail receiving portion slides along said inclined intermediate portion to fall into and be temporarily stored within said mail holding portion.

6. The mailbox according to claim 2 wherein said mail holding portion has a front side and a back side.

7. A mailbox comprising:

a mail receiving portion;

an inclined intermediate portion having an upper end and a lower end, said upper end of said inclined portion being interconnected with said mail receiving portion; and a mail holding portion interconnected with said lower end of said inclined portion;

said mail holding portion having a front side and a back side;

said front side of said mail holding portion including a mail holding portion access door aperture and a mail holding portion access door;

said access door being slidably mounted adjacent said mail holding portion access door aperture;

whereby mail placed within said mail receiving portion slides along said inclined intermediate portion to fall into and be temporarily stored within said mail holding portion.

8. The mailbox according to claim 7 wherein said access door is lockable.

9. The mailbox according to claim 8 wherein said access door has a water-deflecting lip mounted thereover.

10. A mailbox comprising:

a mail receiving portion;

an inclined intermediate portion having an upper end and a lower end, said upper end of said inclined portion being interconnected with said mail receiving portion;

a mail holding portion interconnected with said lower end of said inclined portion and having a front side and a back side, said back side being flushly fittable against a mailbox post having at least one flat side;

a mailbox post attachment region; and said mail receiving portion being offset relative said mailbox post attachment region;

whereby mail placed within said mail receiving portion slides along said inclined intermediate portion to fall into and be temporarily stored within said mail holding portion.

11. The mailbox according to claim 10 wherein said back side has an upper region and a lower region.

12. A mailbox comprising:

a mail receiving portion;

an inclined intermediate portion having an upper end and a lower end, said upper end of said inclined portion being interconnected with said mail receiving portion;

a mail holding portion interconnected with said lower end of said inclined portion;

said mail holding portion includes a front side and a back side;

said back side being flushly fittable against a mailbox post having at least one flat side;

said back side having an upper region and a lower region;

said back side including an outwardly extending flange situated approximately at said upper region, wherein said extending flange being provided for resting upon the top of a mailbox post;

whereby mail placed within said mail receiving portion slides along said inclined intermediate portion to fall into and be temporarily stored within said mail holding portion.

13. A mailbox comprising:

a mail receiving portion including a door end having a height and width and including an operable door for insertion of mail therein;

an inclined intermediate portion having an upper end and a lower end and a base having a width and length, said upper end being interconnected with said mail receiving portion;

a mail holding portion interconnected with said lower end of said inclined portion;

a mailbox post attachment region;

said mail receiving portion being offset relative said mailbox post attachment region;

whereby mail placed within said mail receiving portion slides along said inclined intermediate portion to fall into and be temporarily stored within said mail holding portion.

14. The mailbox according to claim 13 wherein said height of said door end is between eight and nine inches high and said length of said base of said inclined intermediate portion is at least thirteen inches long.

15. A mailbox comprising:

a substantially horizontal mail receiving portion having a door end and a first chute end;

an inclined intermediate portion having a first chute end and a second chute end, said first chute end of said mail receiving portion interconnecting said first chute end of said inclined portion; and a substantially vertical mail holding portion having an upper end portion and a base portion, said second chute end of said inclined portion interconnecting said upper end portion of said mail holding portion;

a mailbox post attached region;

said mail receiving portion being offset relative said mailbox post attachment region;

whereby mail placed within said mail receiving portion slides along said inclined portion to fall into and be temporarily stored within said mail holding portion.

16. The mailbox according to claim 15 wherein said door end of said mail receiving portion includes an operable door pivotally mounted thereto.

17. The mailbox according to claim 15 wherein said mail holding portion has a front side and a back side, said front side being fitted with a mail holding portion access door and said back side being mountable to a mailbox post.

18. A mailbox comprising:

a mail receiving portion;

an inclined intermediate portion having an upper end and a lower end, said upper end of said inclined portion being interconnected with said mail receiving portion;

a mail holding portion interconnected with said lower end of said inclined portion and having a front side and a back side, said front side including an access door aperture and an access door; and a mailbox post attachment region;

said mail receiving portion being offset relative said mailbox post attachment region;

whereby mail placed within said mail receiving portion slides along said inclined intermediate portion to fall into and be temporarily stored within said mail holding portion.

19. A mailbox comprising:

a mail receiving portion;

an inclined intermediate portion having an upper end and a lower end, said upper end of said inclined portion being interconnected with said mail receiving portion;

a mail holding portion interconnected with said lower end of said inclined portion;

said mailbox being composed of metal;

a mailbox post attachment region; and said mail receiving portion being offset relative said mailbox post attachment region;

whereby mail placed within said mail receiving portion slides along said inclined intermediate portion to fall into and be temporarily stored within said mail holding portion.

20. A mailbox comprising:

a mail receiving portion;

an inclined intermediate portion having an upper end and a lower end, said upper end of said inclined portion being interconnected with said mail receiving portion; and a mail holding portion interconnected with said lower end of said inclined portion;

said mailbox being composed of a polymerized material;

a mailbox post attachment region; and said mail receiving portion being offset relative said mailbox post attachment region;

whereby mail placed within said mail receiving portion slides along said inclined intermediate portion to fall into and be temporarily stored within said mail holding portion.

* * * * *